US009252497B2

(12) United States Patent
Tiezzi et al.

(10) Patent No.: US 9,252,497 B2
(45) Date of Patent: Feb. 2, 2016

(54) HYBRID SINGLE APERTURE INCLINED ANTENNA

(71) Applicant: ViaSat, Inc., Carlsbad, CA (US)

(72) Inventors: Ferdinando Tiezzi, Renens (CH); Stefano Vaccaro, Gland (CH); Daniel Llorens del Rio, Lausanne (CH)

(73) Assignee: ViaSat, Inc., Carlsbad, CA (US)

( * ) Notice: Subject to any disclaimer, the term of this patent is extended or adjusted under 35 U.S.C. 154(b) by 328 days.

(21) Appl. No.: 14/023,906

(22) Filed: Sep. 11, 2013

(65) Prior Publication Data

US 2014/0009357 A1 Jan. 9, 2014

Related U.S. Application Data

(63) Continuation of application No. 12/826,475, filed on Jun. 29, 2010, now Pat. No. 8,558,740.

(60) Provisional application No. 61/221,504, filed on Jun. 29, 2009, provisional application No. 61/250,775, filed on Oct. 12, 2009, provisional application No. 61/323,285, filed on Apr. 12, 2010.

(51) Int. Cl.
*H01Q 21/00* (2006.01)
*H01P 1/04* (2006.01)

(52) U.S. Cl.
CPC ..... *H01Q 21/00* (2013.01); *H01P 1/047* (2013.01)

(58) Field of Classification Search
CPC ..... H01Q 21/00
USPC ..... 343/844, 893; 455/561, 562
See application file for complete search history.

(56) References Cited

U.S. PATENT DOCUMENTS

| | | | | |
|---|---|---|---|---|
| 6,483,406 | B1 | 11/2002 | Sawa | |
| 2003/0092402 | A1 * | 5/2003 | Shapira | H04B 7/0615 455/101 |
| 2003/0162566 | A1 * | 8/2003 | Shapira | H01Q 1/246 455/561 |
| 2011/0028103 | A1 * | 2/2011 | Rofougaran | H01Q 1/2258 455/77 |
| 2011/0109507 | A1 * | 5/2011 | Warnick | H01Q 21/061 342/368 |

FOREIGN PATENT DOCUMENTS

WO WO0054367 9/2000

OTHER PUBLICATIONS

Notice of Allowance dated Jun. 14, 2013 in U.S. Appl. No. 12/826,475.

(Continued)

*Primary Examiner* — Huedung Mancuso
(74) *Attorney, Agent, or Firm* — Snell & Wilmer L.L.P.

(57) ABSTRACT

In an exemplary embodiment, an antenna architecture comprises a single aperture having both receive elements and transmit elements, where the single aperture has the performance of a dual-aperture but in about half the size. Moreover, in the case of an array with inclined elements, there is the need to interconnect a planar substrate with an inclined substrate at an angle. An exemplary single aperture comprises a metal core having a thick pass-through slot from a first side to a second side; connecting the inclined substrate to the first side of the metal core, and connecting a second substrate to the second side of the metal core. Furthermore, an RF signal is communicated between the first substrate and the second substrate in a contactless manner through the thick pass-through slot.

16 Claims, 15 Drawing Sheets

(56) References Cited

OTHER PUBLICATIONS

Office Action dated Jan. 16, 2013 in U.S. Appl. No. 12/826,475.
Restriction Requirement dated Nov. 16, 2012 in U.S. Appl. No. 12/826,475.
International Search Report and Written Opinion dated Dec. 2, 2010 in PCT/US2010/040458.
International Preliminary Report on Patentability dated Jan. 4, 2012 in PCT/US2010/040458.
Intention to Grant dated Dec. 5, 2012 in EP Application No. 10731876.8.

* cited by examiner

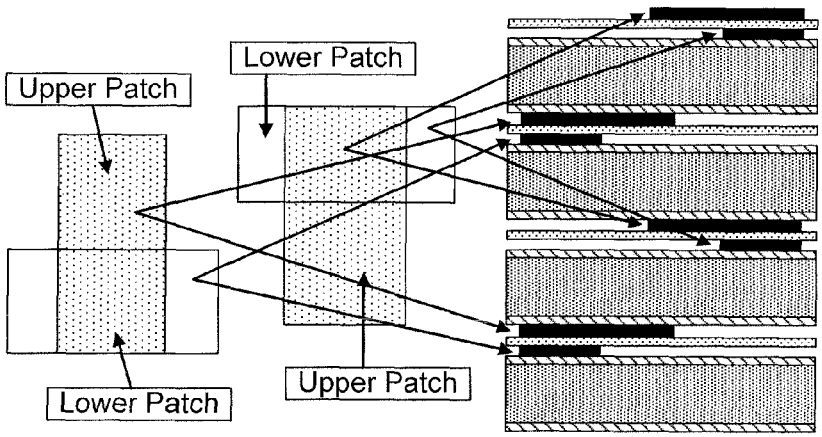
Figure 11(a)
Figure 11(b)
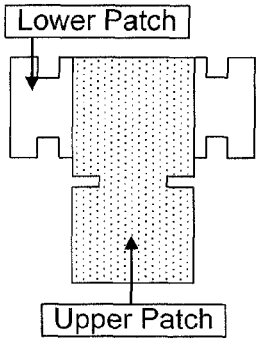
Figure 11(c)
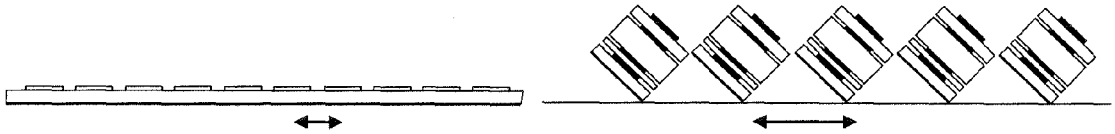
Figure 12

HYBRID SINGLE APERTURE INCLINED ANTENNA

CROSS REFERENCE TO RELATED APPLICATIONS

This application is a continuation of U.S. application Ser. No. 12/826,475, entitled "HYBRID SINGLE APERTURE INCLINED ANTENNA," which was filed Jun. 29, 2010. The '475 application is a non-provisional of U.S. Provisional Application No. 61/221,504, entitled "HYBRID SINGLE APERTURE INCLINED ANTENNA," which was filed on Jun. 29, 2009. The '475 application is also a non-provisional of U.S. Provisional Application No. 61/250,775, entitled "HYBRID SINGLE APERTURE INCLINED ANTENNA," which was filed on Oct. 12, 2009. The '475 application is also a non-provisional of U.S. Provisional Application No. 61/323,285, entitled "DESIGN AND PROTOTYPING OF A MICROSTRIP TRANSMIT-RECEIVE ARRAY ANTENNA FOR MOBILE KU-BAND SATELLITE TERMINALS," which was filed on Apr. 12, 2010. All of the contents of the previously identified applications are hereby incorporated by reference for any purpose in their entirety.

FIELD OF THE INVENTION

The present application relates to the structure of a radiating element, specifically to radio frequency (RF) connections between planar-to-planar and planar-to-inclined surfaces. Furthermore, the application also relates to the configuration of an array of radiating elements of a hybrid steerable beam antenna integrating receive and transmit capabilities in the same aperture.

BACKGROUND OF THE INVENTION

Many existing and future broadband satellite services require small, lightweight and low-cost antennas to be mounted on mobile platforms, such as vehicles, trains, and airplanes, or antennas integrated on portable systems or installed in fixed positions on buildings. In order to minimize the size and/or the thickness of the antenna and to provide beam steering capabilities, array antennas are often applied for wall-mount applications, portable applications and mobile front-end applications.

Satellite services with large capacity and fast connection speed often apply high frequency bands (e.g. Ku, Ka and Q-band) which typically have large frequency ranges for downlink and uplink channels. These services also typically have large spacing between transmit and receive bands in order to avoid interferences between uplink and downlink signals. The large bandwidths and the large spacing between bands make it difficult to design antenna arrays using the same aperture for both uplink and downlink functions. One solution used in many products is to split the antenna aperture in two parts, one aperture for receiving signals and another aperture for transmitting signals.

An advantageous approach is to use the same surface and volume of the antenna for both transmit and receive functionalities. This is generally achieved in reflector antennas through the design of wideband feeds which integrate diplexers to separate transmit and receive signals. However, using the same surface is difficult in array antennas where wideband elements tend to loose radiation efficiency in the required bands and where the integration of active components (e.g. for beam steering) includes a separation of transmit and receive signals at each element, generally resulting in an increase in costs and integration issues.

Additionally, integrating two types of elements, one for transmit and one for receive, in the same surface, may result in a high coupling between elements that affects quality of the radiation of the antenna. Typically, the antenna design is very challenging because the spacing between radiating elements is very small and field couplings very high. The high couplings between the two types of elements can cause problems on the generation of the beam forming and power isolation between the transmit and receive chain. Overall, designing the receive function and the transmit function onto a single aperture may result in inefficiencies, increased complexity and cost, and high coupling between the radiating elements.

Thus, it is desirable to have an antenna architecture having both transmit and receive elements on a single aperture, and where the antenna architecture is configured to operate efficiently and with reduced coupling between the elements.

SUMMARY OF THE INVENTION

In an exemplary embodiment, an antenna architecture comprises a single aperture having both receive elements and transmit elements. Furthermore, in an exemplary embodiment, the array beam forming network and active circuitry are integrated into a low-profile structure, thus making it suitable for integration on vehicles for communications on the move.

Furthermore, in an exemplary method, an antenna array is designed to take advantage of the entire surface of the aperture for both transmit and receive functions. The application of original design concepts allows building an antenna having the performances of a dual-aperture joined in a single aperture having about half the size.

In the exemplary embodiment, the shape of the receiving and transmitting patches is designed to integrate both receive and transmit elements in the antenna aperture while minimizing the coupling between the two types of elements. Moreover, different shapes of the apertures in the ground plane can have different effects on the performance of an antenna. For example, an H-shaped slot or a dual-C slot have the advantage to make the slot smaller compared to linear slots, thus reducing back radiation and increasing antenna efficiency.

Moreover, in the case of an array with inclined elements, there is the need to interconnect a planar substrate, such as a printed circuit board (PCB) with an inclined substrate at an angle. In an exemplary embodiment, a planar PCB interconnects with an inclined PCB using a thick slot transition. A thick slot transition is a connecting hole through a core, where the planar PCB is located on one side of the core and the inclined PCB is located on the other side of the core. A benefit of implementing the cut-through interconnection of the two PCBs is the reduction of mechanical assembling, such as a reduction in the amount of soldering used to form a connection.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

FIGS. 11A-11C illustrate exemplary embodiments of a radiating element and T-shaped patch design;

FIG. 12 illustrates exemplary planar and inclined array structures;

DETAILED DESCRIPTION

While exemplary embodiments are described herein in sufficient detail to enable those skilled in the art to practice the invention, it should be understood that other embodiments may be realized and that logical material, electrical, and mechanical changes may be made without departing from the spirit and scope of the invention. Thus, the following detailed description is presented for purposes of illustration only.

Figure 1:
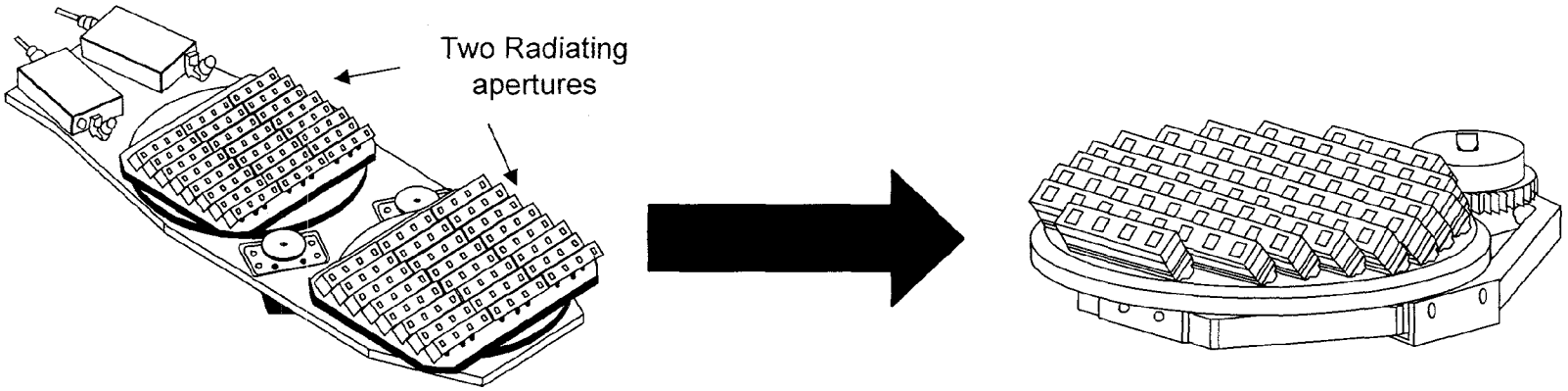
FIG. 1 illustrates a typical dual-aperture antenna converted into an exemplary single aperture antenna.

As illustrated in FIG. 1, an exemplary embodiment of an antenna array configuration integrates radiating elements, active components, and beam-forming networks of receive and transmit apertures in a single aperture. Furthermore, in an exemplary embodiment, the single aperture has equivalent size of one of prior art dual apertures, and still maintains the performance level of the dual aperture antenna.

Figure 2:
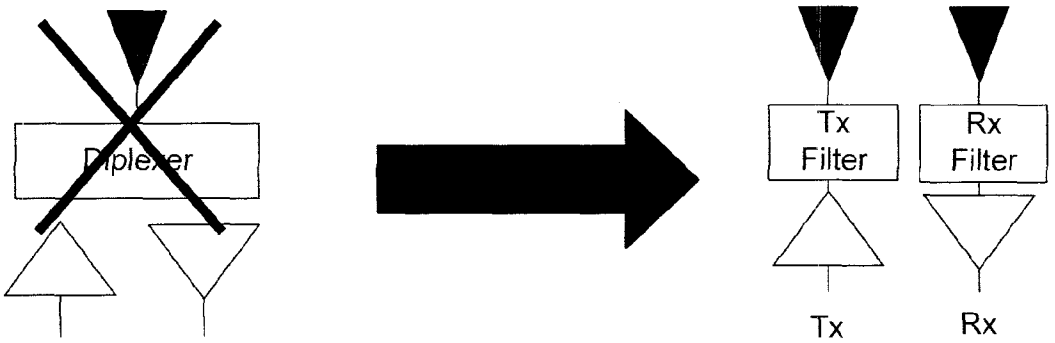
FIG. 2 illustrates a typical diplexer embodiment converted into exemplary separate transmit and receive chains.

In a typical antenna, a transmit radiating element and a receive radiating element are coupled to a diplexer to form a combined transmit and receive chain. However, the diplexer is generally a bulky component with high insertion loss. In contrast, in an exemplary embodiment, and with reference to FIG. 2, each radiating element is connected to an individual filter, so that each receive chain and transmit chain is separate. This reduces the complexity and size of implementing diplexing circuits, which are typically used in prior art antennas. The individual filters are simpler and more efficient filters in comparison to diplexing circuits.

Figure 3:
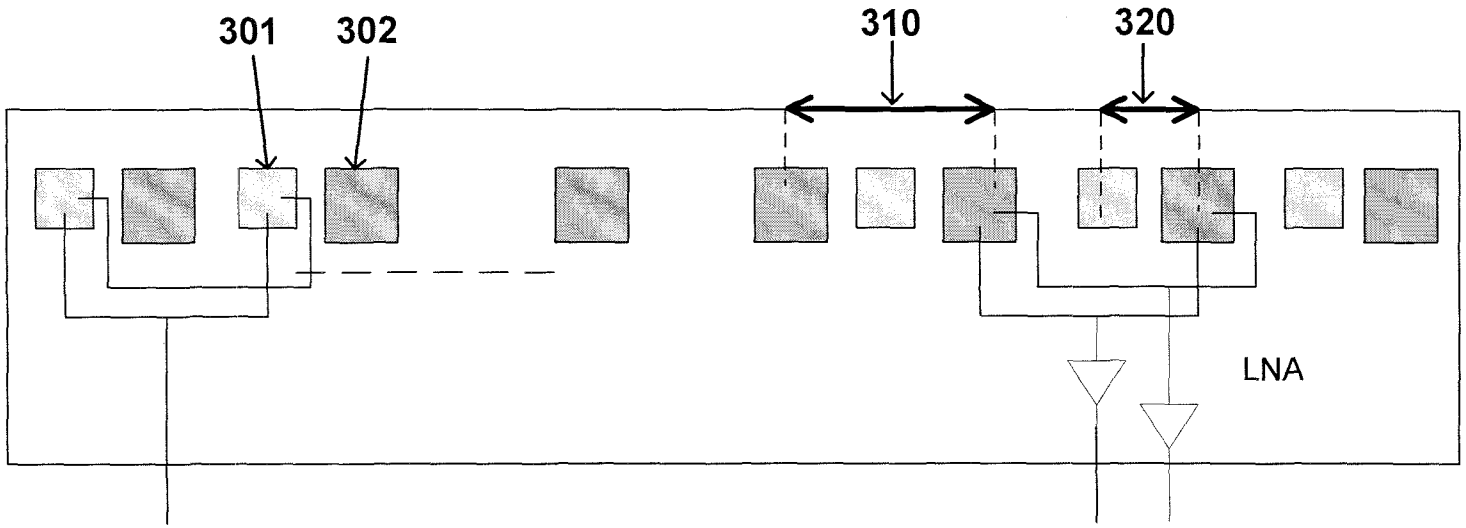
FIG. 3 illustrates an exemplary embodiment of interleaved transmit and receive radiating elements.
Figure 4:
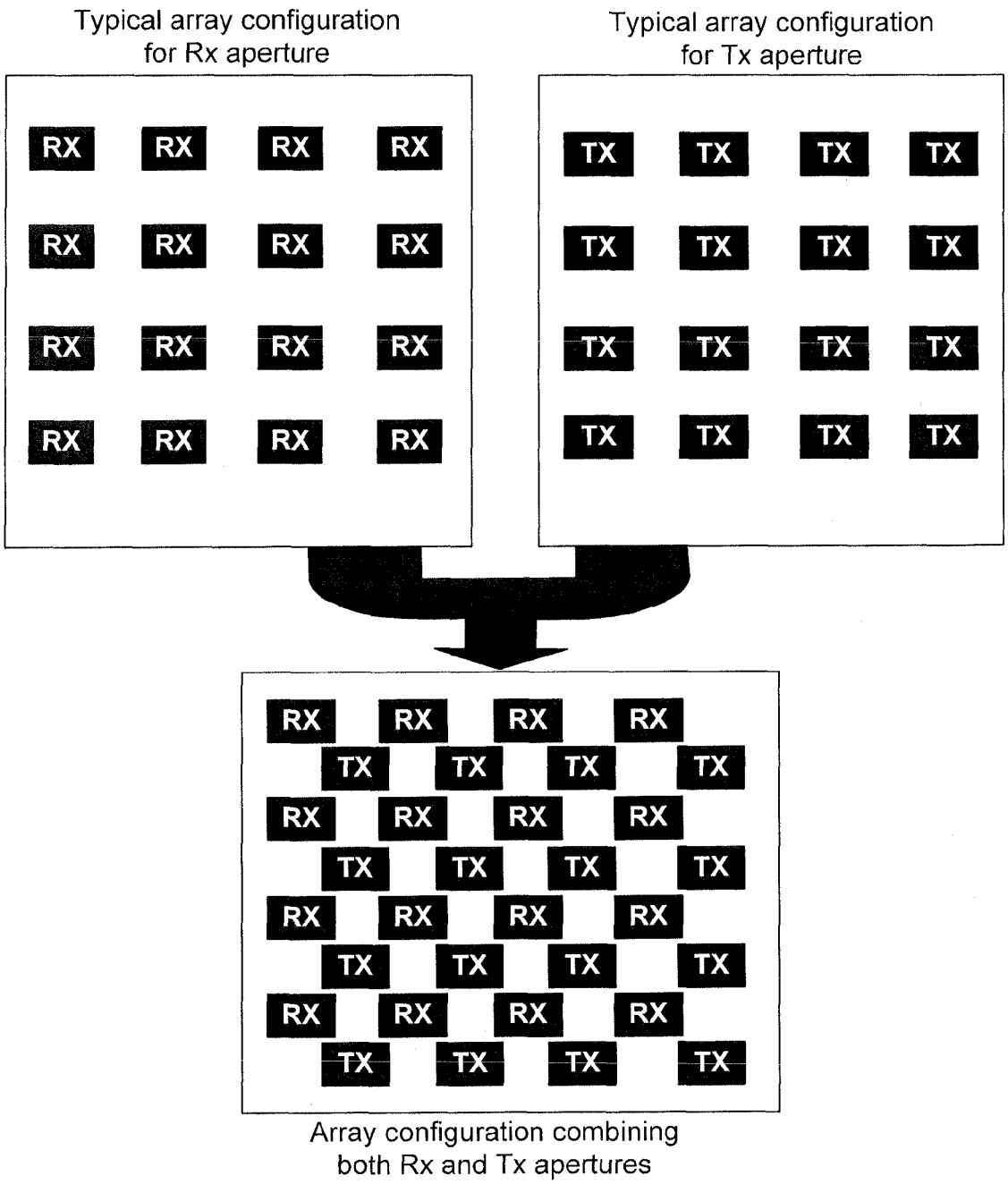
FIG. 4 illustrates combining a typical receive aperture array configuration and a typical transmit aperture array configuration into an exemplary transmit/receive array configuration.

In an exemplary embodiment and with reference to FIG. 3, a single aperture antenna performs both the transmit function and the receive function. Furthermore, in an exemplary embodiment, the single aperture antenna is designed with dense integration of radiating elements for increased efficiency, and dense integration for beam forming networks and electronic circuitry. In another exemplary embodiment, close spacing of interleaved receive and transmit radiating elements results in an array configuration minimizing grating lobes and side lobes. FIG. 4 illustrates one example of a typical receive aperture and typical transmit aperture condensed into a single aperture. In one exemplary embodiment and with continued reference to FIG. 3, a radiating element is within about 0.5 wavelength of the nearest radiating element (shown by 320) and within about 1 wavelength of the nearest radiating element of the same type (shown by 310). In other words, a receive element is within about 0.5 wavelength of a transmit element, and within about 1 wavelength of the nearest receive element. The wavelength is the highest radiating frequency of the radiating elements. In an exemplary embodiment, the distances between radiating elements is described from the approximate center of a first radiating element to the approximate center of a second radiating element. This spacing facilitates the isolation between transmit and receive chains to avoid receive saturation and interferences.

Figure 5:
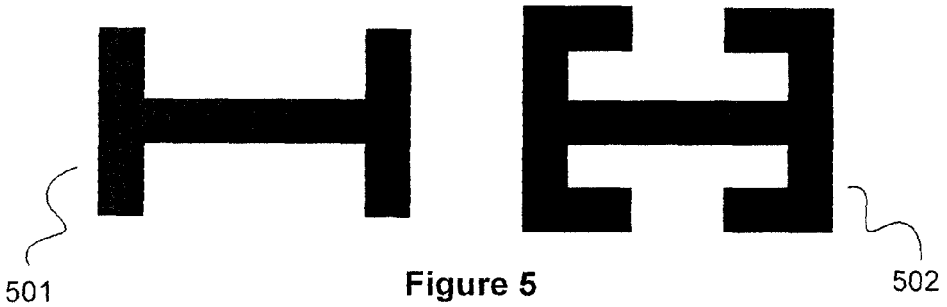
FIG. 5 illustrates exemplary H-shaped and dual C-shaped slots.

In an exemplary embodiment, the radiating elements are based on microstrip patch antennas. In the exemplary embodiment, the shape of the receiving and transmitting patches is designed to integrate both receive and transmit elements in the antenna aperture while minimizing the coupling between the two types of elements. In an exemplary embodiment, the radiating element is coupled by at least one of a coaxial probe, microstrip line, proximity coupling, aperture coupling, and other suitable devices. Electromagnetically coupling a microstrip line through an aperture on the ground plane of the element has several advantages in terms of bandwidth, polarization purity, and isolation between feed lines and radiating elements. Moreover, different shapes of the apertures in the ground plane can have different effects on the performance of an antenna. For example, and as illustrated in FIG. 5, an H-shaped slot 501 or a dual-C slot 502 have the advantage to make the slot smaller compared to linear slots, thus reducing back radiation and increasing antenna efficiency.

In another exemplary embodiment, one or more stacked radiating elements comprising a T-shaped patch has increased efficiency and bandwidth compared to a prior art single patch. Furthermore, the patch may be suitable shapes other than the T-shape, such as the H-shape, triangular shape, and the like. Additionally, the T-shaped antenna has good radiation characteristics and low inter-element coupling. Therefore, in an exemplary embodiment, the T-shaped antenna is well suited to build arrays, specifically arrays with electronic beam scanning capabilities, where the low coupling between adjacent elements allows achieving easily large scanning ranges without having to compensate for mutual coupling effects due to beam scanning.

Figure 6:
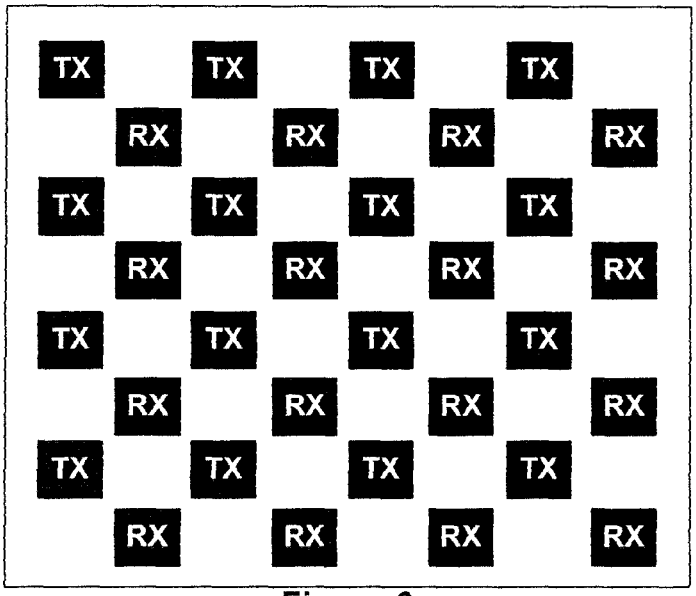
FIG. 6 illustrates an exemplary embodiment of an array configuration comprising alternating T-shaped patches.
Figure 7:
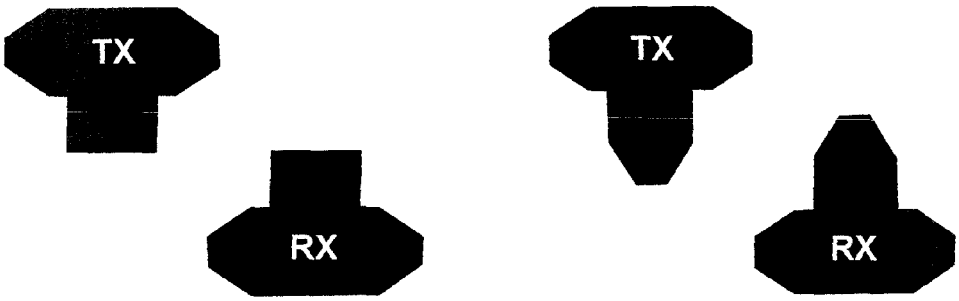
FIG. 7 illustrates various exemplary embodiments of T-shaped patch antennas with chamfered edges.
Figure 8:
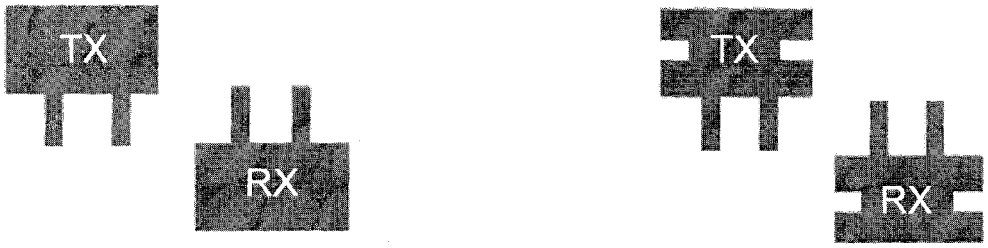
FIG. 8 illustrates various exemplary embodiments of T-shaped patch antennas with slits.
Figure 9:
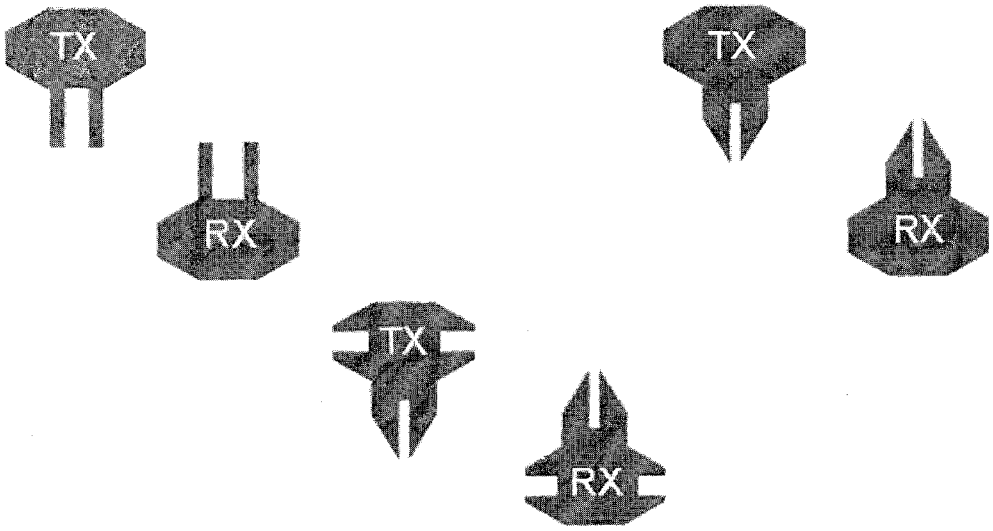
FIG. 9 illustrates various exemplary embodiments of T-shaped patch antennas having rounded edges and slits.
Figure 10:
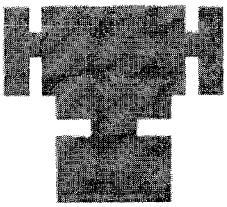
FIG. 10 illustrates an exemplary embodiment of a T-shaped antenna with slits perpendicular to the resonant modes.

In an exemplary embodiment and with reference to FIG. 6, the receiving and transmitting T-shaped patches are interleaved and inverted, where one type of patch is turned opposite the other type of patch. In another exemplary embodiment, a patch antenna is shaped like a "T" with trimmed or chamfered (rounded) edges, either on all or some of the radiating element edges, as shown in FIG. 7. In other various embodiments, the patch antenna has at least one slit in the T-shape. The slits may be parallel to the resonant modes as shown in the examples in FIGS. 8 and 9. In another embodiment, the slits may be perpendicular to the resonant modes, as shown in the example in FIG. 10. In yet another embodiment, the parallel and perpendicular slits may be used in combination. The slits may be made in the radiating element in order to reduce the physical size, which also helps to reduce the couplings with adjacent elements.

In accordance with an exemplary embodiment and with reference to FIGS. 11A-11C, a radiating element comprises two separate patches in different planes that operate with similar functionality as a single-piece T-shaped radiating element. In an exemplary embodiment, the two parts of the radiating element are located in two separate positions and the spacing is adjusted to obtain special behavior. Specifically, the two radiating element parts are parallel to each other and located in two different planes. In an exemplary embodiment, the two parts of the radiating element are separated by a thin dielectric layer. Designing a thin separation of the two parts results in similar behavior compared to a single piece radiating element. One way of implementation is etching of the two structures in two metalized faces of a printed circuit board (PCB). Dividing the radiating elements in a non-planar arrangement results in polarization purity, reduction of coupling, and improved radiation pattern quality.

As previously discussed, in an exemplary embodiment, an antenna comprises a single aperture having both receive and transmit radiating elements. The transmit and receive functions operate at two different frequency bands and are isolated between the radiating elements. In an exemplary embodiment and with reference to FIG. 12, the antenna structure is a planar array antenna with radiating elements arranged in rows and columns in the same planar surface. In another exemplary embodiment and with continued reference to FIG. 12, the antenna structure is a low profile hybrid mechanical-electronic steerable array with inclined radiating elements. For additional details regarding exemplary antenna structures and methods for increasing performance at low elevation angles, see U.S. patent application Ser. No. 12/463,101, entitled "Inclined Antenna Systems and Methods", which is hereby incorporated by reference.

In addition to the difficulty of radiating element proximity, the design of a combined transmit/receive array antenna with beam and polarization control also has a high complexity in the integration of several components. The several components include feed networks and special interconnections between separated printed circuit boards. The components include RF feed networks plus DC and logic circuits for power supply of electronics and for control of beam and polarization. For example, in the case of a dual-linear transmit/receive antenna, four separated feed networks are integrated in the antenna structure.

Moreover, in the case of an array with inclined elements, there is the need to interconnect a planar PCB with an inclined PCB at an angle. The inclined PCB may be at an angle of 45 degrees from the planar PCB. In another embodiment, the inclined PCB is within the range of 15-65 degrees from the planar PCB, though there are other suitable angles. In an exemplary embodiment, a planar PCB interconnects with an inclined PCB using a slot transition. A slot transition is a connecting hole through a core, where the planar PCB is located on one side of the core and the inclined PCB is located on the other side of the core.

A benefit of implementing the cut-through interconnecting the two PCBs is the reduction of mechanical assembling, such as a reduction in the amount of soldering used to form a connection. This benefit provides an advantage in that it allows testing of the antenna sub-arrays with little or no damage or stress to the array. Additionally, in an exemplary embodiment, replacement of arrays takes place with little or no damage to the whole antenna, and the replacement may be accomplished in a cost effective manner.

Planar Thick Slot Transition

Figure 13A:
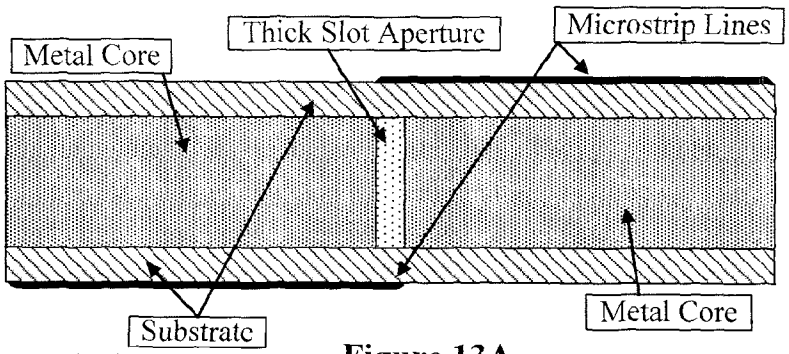
FIGS. 13A-13B illustrate exemplary embodiments of a transversal section of a contactless interconnection between printed circuit boards.
Figure 13B:
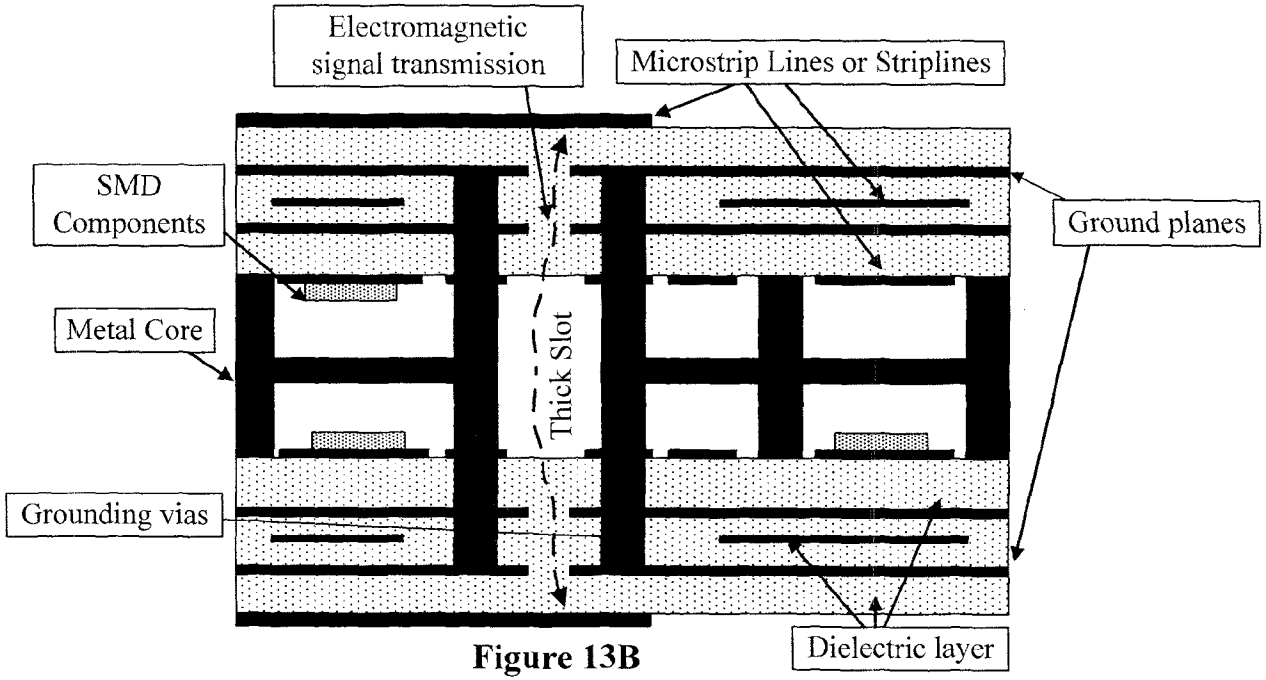

In an exemplary embodiment, an array comprises a first interconnection designed to facilitate RF connectivity between two planar multilayer circuit boards without any direct physical contact between the two boards. In one embodiment, soldering is not used in the connection between the planar boards. In a specific exemplary embodiment and with reference to FIGS. 13A-13B, a transversal section of the first interconnection is illustrated. FIG. 13A illustrates an interconnection between two single layer boards, while FIG. 13B illustrates an interconnection between two multi-layer boards, such as PCBs. In general, PCBs are separated by a metallic core (or other suitable material), with a slot (also referred to as a hole or transversal section) through the metallic core to allow the passing of RF energy between the microstrips of the top and bottom PCBs in a contactless manner. In an exemplary embodiment, a first microstrip on the top PCB is a feed of a radiating element and a second microstrip on the bottom PCB is connected to an antenna circuit. The antenna circuit may be at least one of a transceiver, a transmitter, and a receiver. The slot may be designed to adjust the electromagnetic coupling among the top and the bottom metalized layers.

Figure 14:
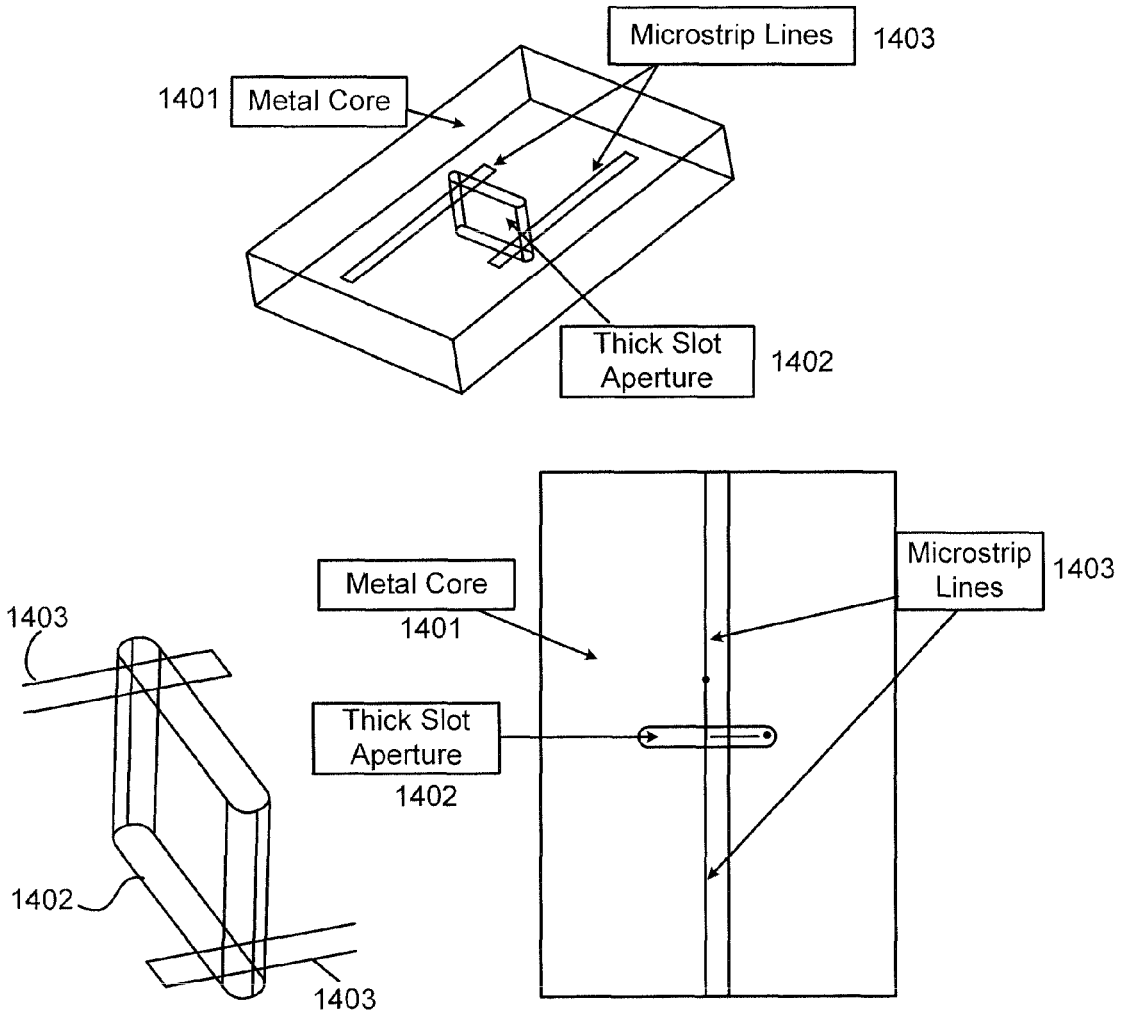
FIG. 14 illustrates perspective views of an exemplary contactless interconnection.

For example, FIG. 14 illustrates a thick slot interconnection 1402 as a hole in a metal core 1401 in the shape of a rectangular slot. The two microstrip lines 1403 are coupling the field inside thick slot 1402 through an open quarter-wavelength stub. The same effect could be obtained with a shorting via just after the line bridge over the slot. In an exemplary embodiment, microstrip lines 1403 are located on PCBs and are parallel to one another. Furthermore, microstrip lines 1403 are perpendicular, or substantially perpendicular, to thick slot 1402 in order to excite the field.

In an exemplary embodiment, the slot length is below the first resonant propagating mode to avoid spurious radiation. In other words, in an exemplary embodiment, the length of the slot is less than the half-wavelength at the frequency of interest. Accordingly, the RF transmission is obtained through proximity coupling. This facilitates having slots (or holes) much smaller than the size of a propagating waveguide. On the other hand, using an aperture under the cut-off frequency is limited in that the transition is inefficient for large thicknesses of the metal core. In one embodiment, the thickness of the metal core is 5 millimeters. In another embodiment, the core thickness is 12 millimeters. In yet another embodiment, the core thickness is greater than 12 millimeters, but transmission efficiency will decrease as the thickness increases.

In an exemplary embodiment, the shape of the slot can be designed depending on specific needs of surface occupation and thickness of the metal core. Typical shapes are circular, rectangular, H-shaped, and the like.

Inclined Thick Slot Transition

Figure 16:
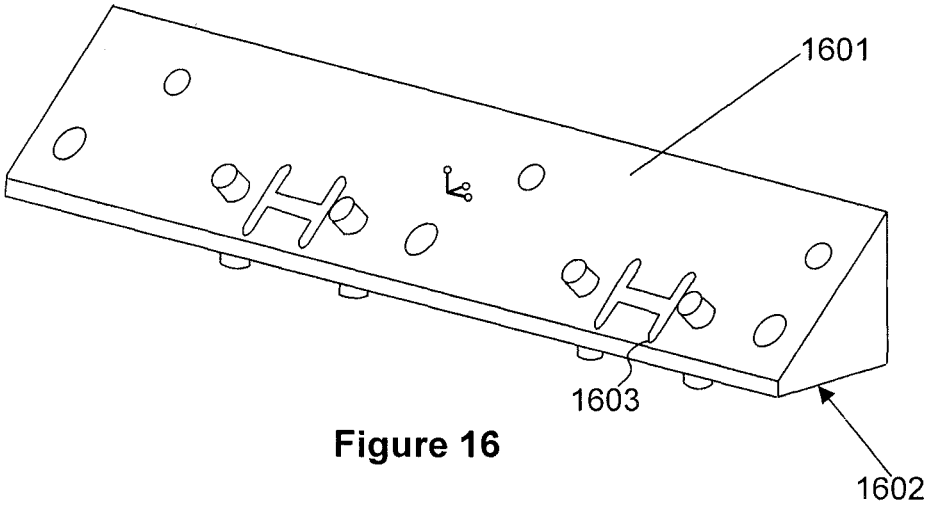
FIG. 16 illustrates a perspective view of an inclined aperture coupled transition.

Similar to the planar thick slot transition, a first PCB inclined with respect to a second PCB may be interconnected in a contactless transition based on an aperture coupling effect. In an exemplary embodiment and with reference to FIG. 16, an array structure comprises a first surface 1601 and a second surface 1602 that are inclined with respect to one another and further comprises a connecting hole 1603 through the structure. The two surfaces 1601, 1602 may be connected at an angle in the range of 30°-60°, or any other suitable angle.

Figure 17:
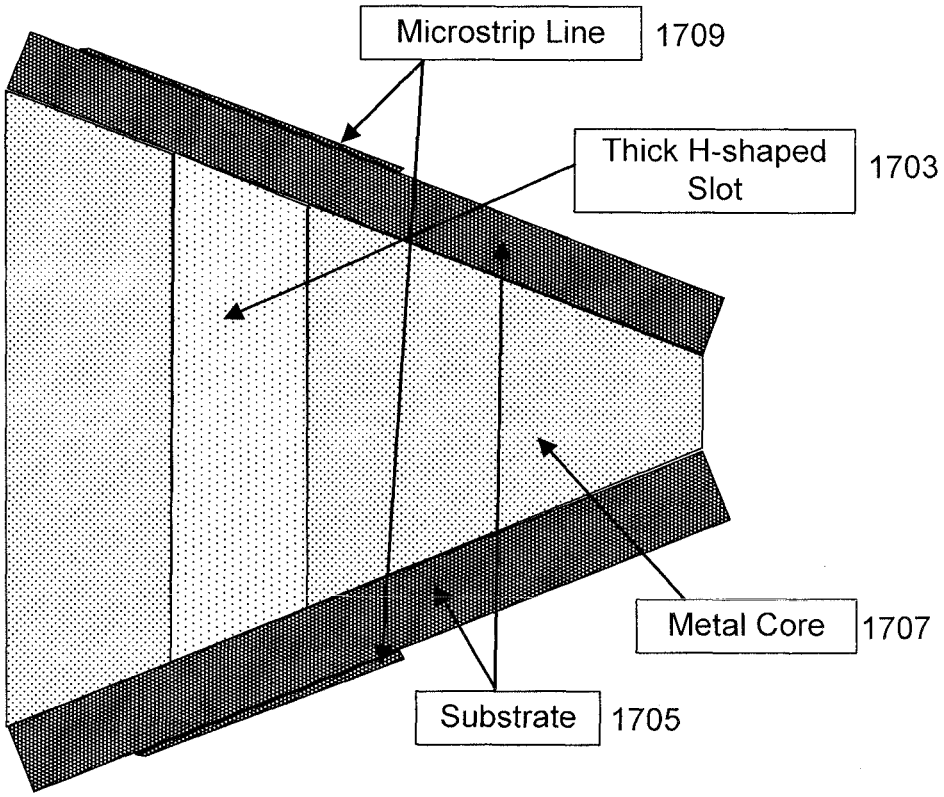
FIG. 17 illustrates a sectional view of an exemplary inclined aperture coupled transition.
Figure 18:
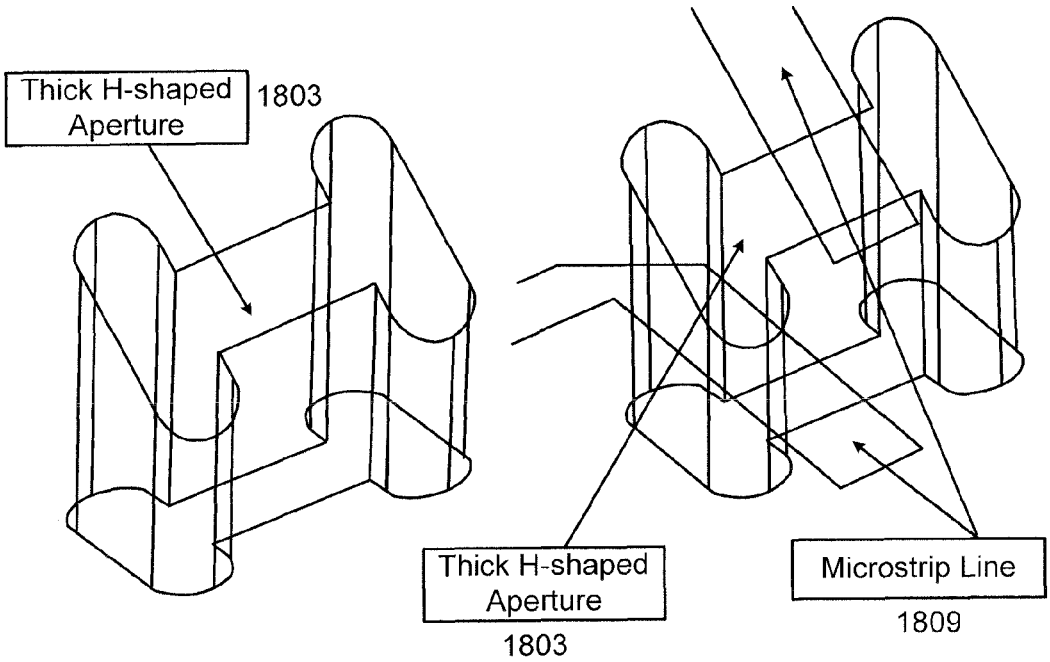
FIG. 18 illustrates exemplary embodiments of an inclined aperture coupled transition with H-shaped slot.
Figure 19A:
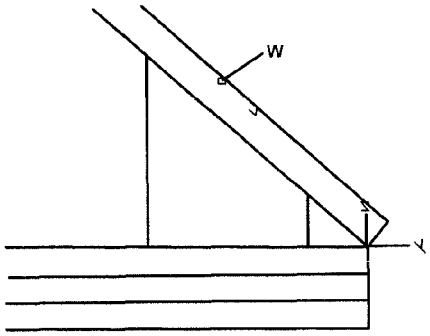
FIGS. 19A-19B illustrate various drilling angles in an inclined aperture.
Figure 19B:
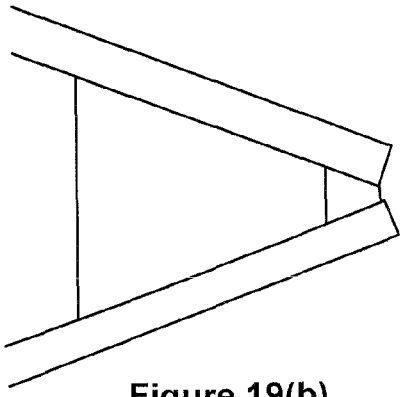

In an exemplary embodiment and with reference to FIG. 17, a connecting hole 1703 is configured to facilitate electromagnetic coupling between two substrates 1705 mounted on each side of a metallic core 1707. Furthermore, a microstrip line 1709 is located on each of substrates 1705 and overlap with connecting hole 1703. Connecting hole 1703 may be circular, rectangular, H-shaped, C-shaped, dual C-shaped or the like. For example, FIG. 18 illustrates an H-shaped slot 1803 and two microstrips 1809 overlaying slot 1803. In an exemplary embodiment, the connecting aperture is formed or drilled in the metal core either perpendicularly to one of the two faces, as shown in FIG. 19A or perpendicular to the bisector of the angle of inclination of the two substrates as shown in FIG. 19B.

In an exemplary embodiment, manufacturing the connecting hole perpendicular to the bisector of the angle of inclination of the two planes is advantageous in that the transition in the faces of the structure is symmetrical and hence simplifies the design. In an exemplary embodiment, the design is also simplified in part as a result of the same microstrip-to-slot transition (i.e., the length of the microstrip open stub) being applied on both sides of the thick slot.

Figure 20:
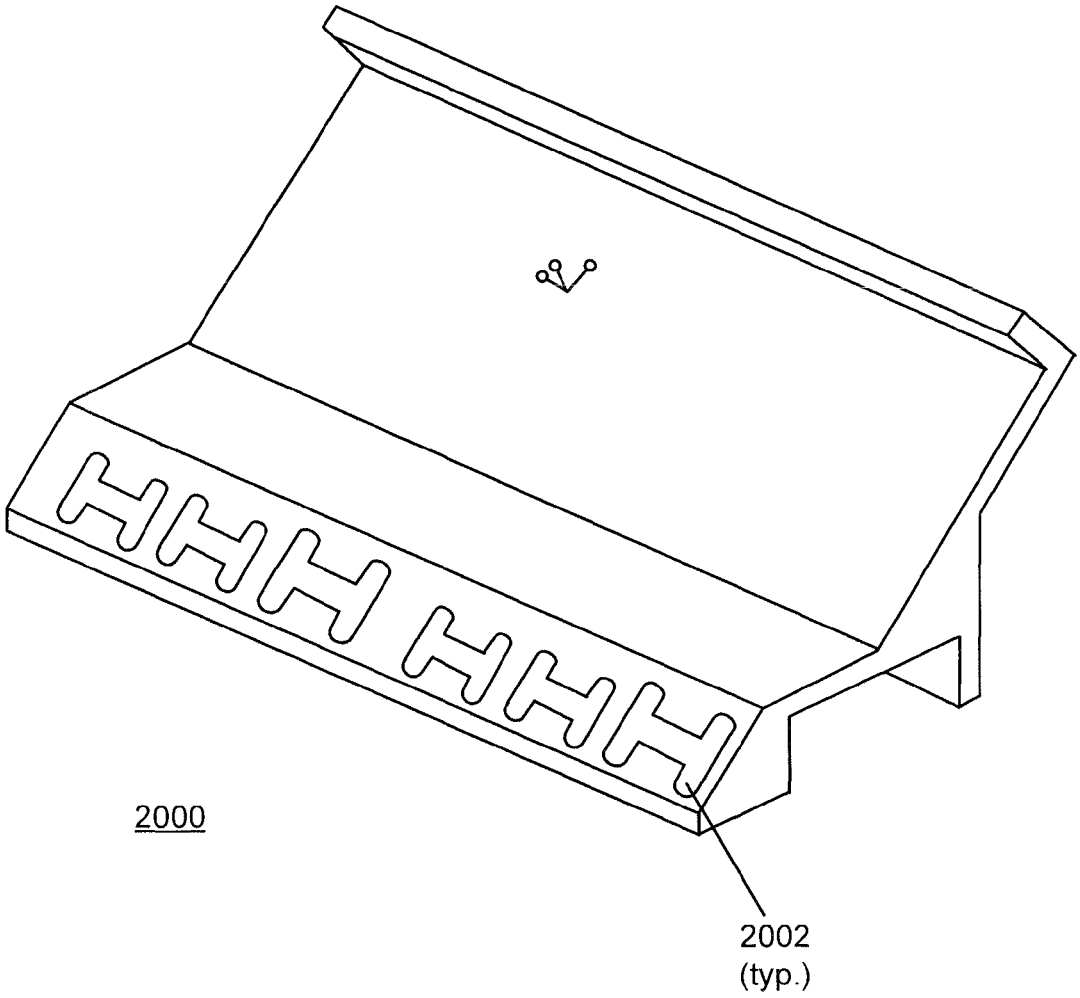
FIG. 20 illustrates an exemplary inclined support structure with multiple slot interconnections.
Figure 21:
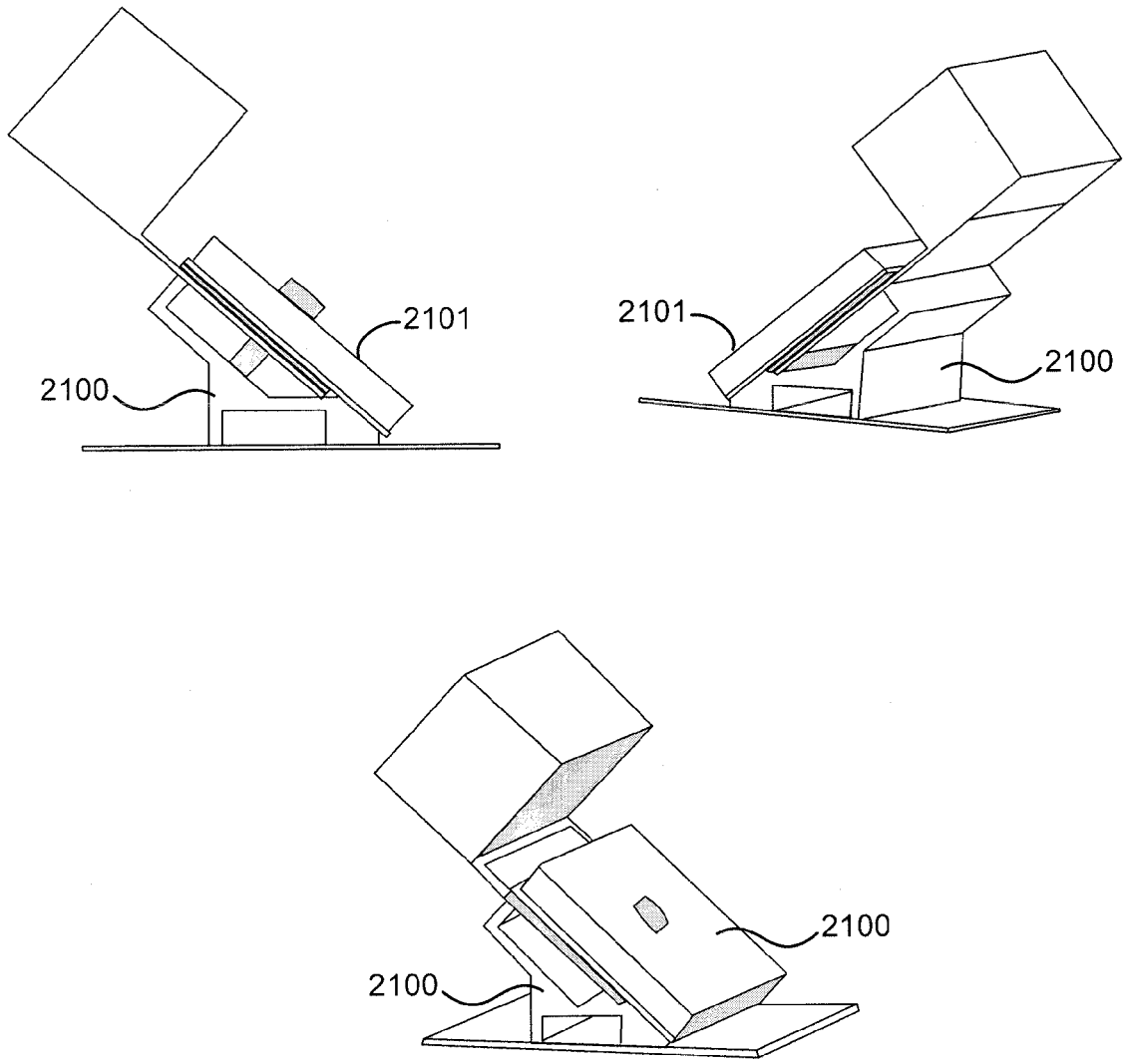
FIG. 21 illustrates perspective views of an exemplary inclined radiating element structure and interconnection.

In yet another exemplary embodiment and with reference to FIG. 20, a support structure 2000 comprises both support for an inclined PCB (not shown) and at least one connecting hole 2002. Furthermore, in an exemplary embodiment and with reference to FIG. 21, a cover 2101 attaches to a support structure 2100, where cover 2101 is on top of an inclined PCB surface in order to shield the interconnection from external interferences. In an exemplary embodiment, cover 2101 prevents spurious radiation from the slot from coupling with the surrounding structures. Such structures include patches, other slots, and the like. Furthermore, cover 2101 may prevent radiation from external signals from coupling to the slot and the microstrip circuits. Moreover, in an exemplary embodiment, cover 2101 is located at a distance of about a quarter wavelength to facilitate improving the efficiency of the slot by acting as a reflector for the spurious radiation.

Planar Thick Coaxial Transition

Figure 15A:
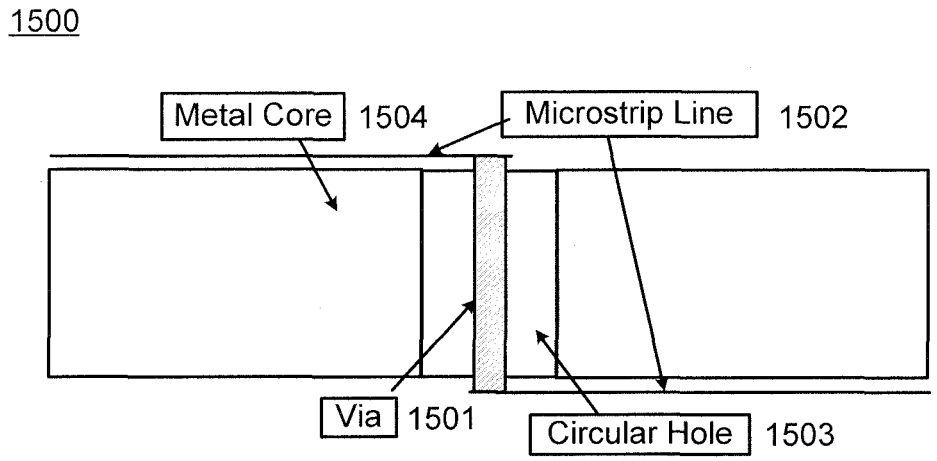
FIG. 15A illustrates a sectional view of an exemplary planar thick coaxial transition.
Figure 15B:
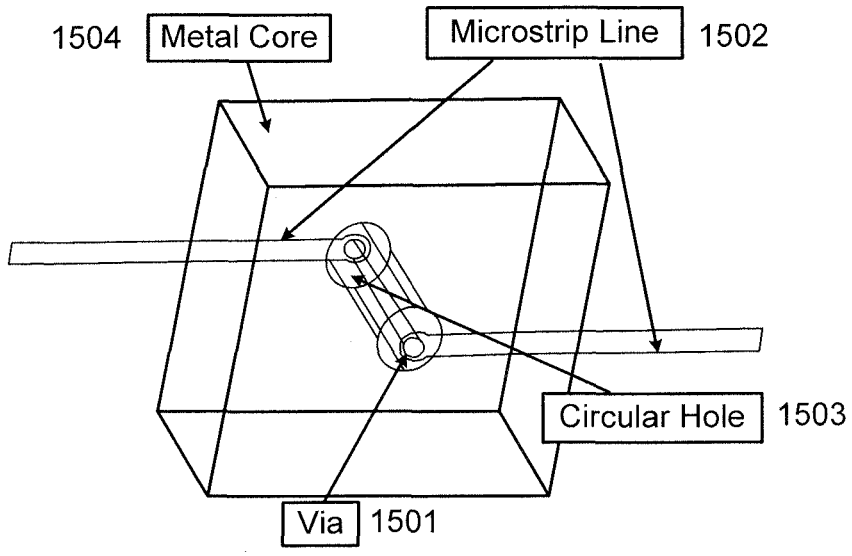
FIG. 15B illustrates a perspective view of an exemplary planar thick coaxial transition.
Figure 15C:
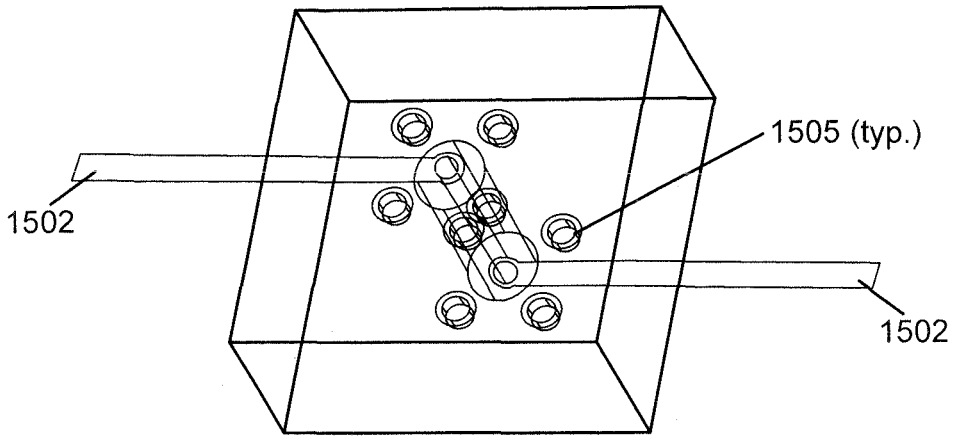
FIG. 15C illustrates a perspective view of another exemplary planar thick coaxial transition with grounding pins.

A second type of structure used to interconnect two planar or inclined PCBs is also based on a metal core with a drilled circular aperture. In an exemplary embodiment, an array comprises a first PCB and a second PCB substantially parallel to one another. Likewise, a microstrip of the first PCB is substantially parallel to a microstrip of the second PCB. In an exemplary embodiment, and with reference to FIGS. 15A-15C, an array 1500 comprises a coaxial wire 1501 connecting two microstrip lines 1502 through an aperture 1503 in a metal core 1504. In one exemplary embodiment and with reference to FIG. 15C, array 1500 further comprises metallic grounding pins 1505 coming out of the planar surface, although a transition structure may be implemented without these pins. In an exemplary embodiment, grounding pins 1505 pass through metalized via holes connected to the microstrip ground. This configuration enables the ground of the microstrip to be soldered to the metal core on an accessible side. In other words, in an exemplary embodiment, pass-through grounding pins facilitate soldering of a signal wire and grounding pins on a single surface.

In an exemplary embodiment, the first and second PCBs to be connected together are mounted on two sides of the metal core. The metal core comprises at least one hole connecting the two sides, and the microstrip lines are attached so that one end of each microstrip is at the hole. The metal core may further comprise one or more grounding pins placed around the hole in the metal core and connecting the pad on top of the first PCB with the ground of the second PCB. The circular aperture can be empty (air) or filled with a dielectric material to reduce the size of the hole.

In another exemplary embodiment, a metallic wire is surrounded by a cylinder of plastic material that fits within the diameter of the hole in the metal core. The metal wire can be first inserted in the metal core and will remain in place supported by the plastic cylinder. Then the first and second PCBs are placed and the contacts soldered.

In an exemplary method of assembly, an interconnection is formed by inserting a metallic wire in a hole of one of two PCBs at the edge of the microstrip of the one PCB and soldered in place. The PCB is mounted on one side of the metal core and the metallic wire slides through the hole in the metal core. In one embodiment, the metallic pins coming out of the metal core are inserted in the grounded metalized via holes in the PCB. The metallic pins can eventually be soldered with the circular pads on the external side of the PCB. The second PCB on the other face of the metal core is then set in place in a similar way inserting the wire in the hole at the edge of the PCB and soldered completing the connection between the two PCB.

Inclined Thick Coaxial Transition

Figure 22:
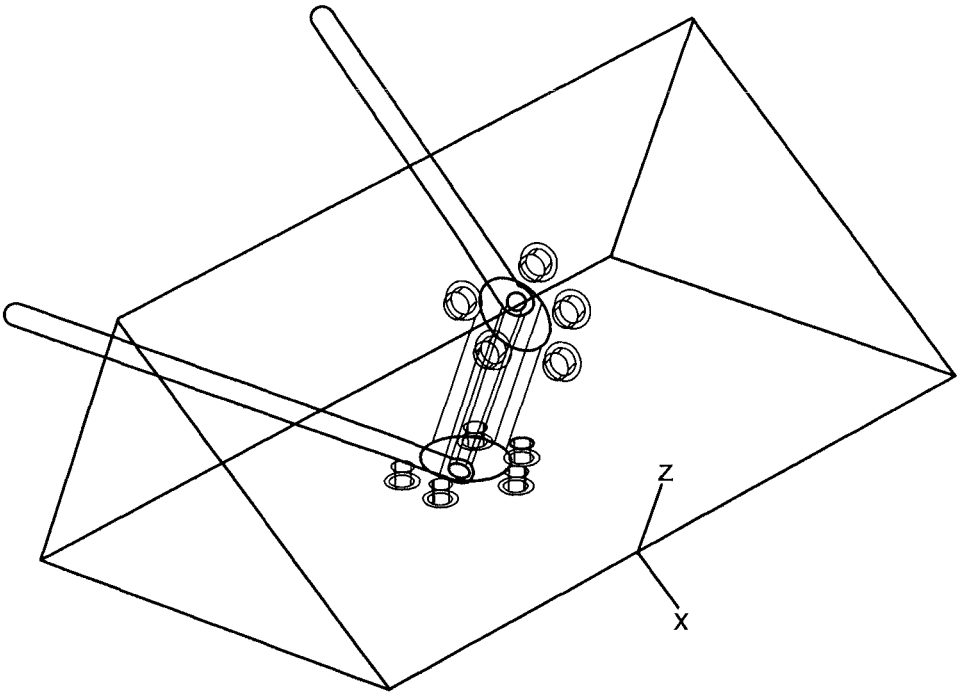
FIG. 22 illustrates an exemplary embodiment of an inclined coaxial transition.

Similar to the planar thick coaxial transition, a first PCB inclined with respect to a second PCB may be interconnected based on a coaxial section. In an exemplary embodiment and with reference to FIG. 22, two surfaces inclined with respect to one another comprise a connecting hole through the structure. The two surfaces may be connected at an angle in the range of 30°-60°, or any other suitable angle.

Figure 23A:
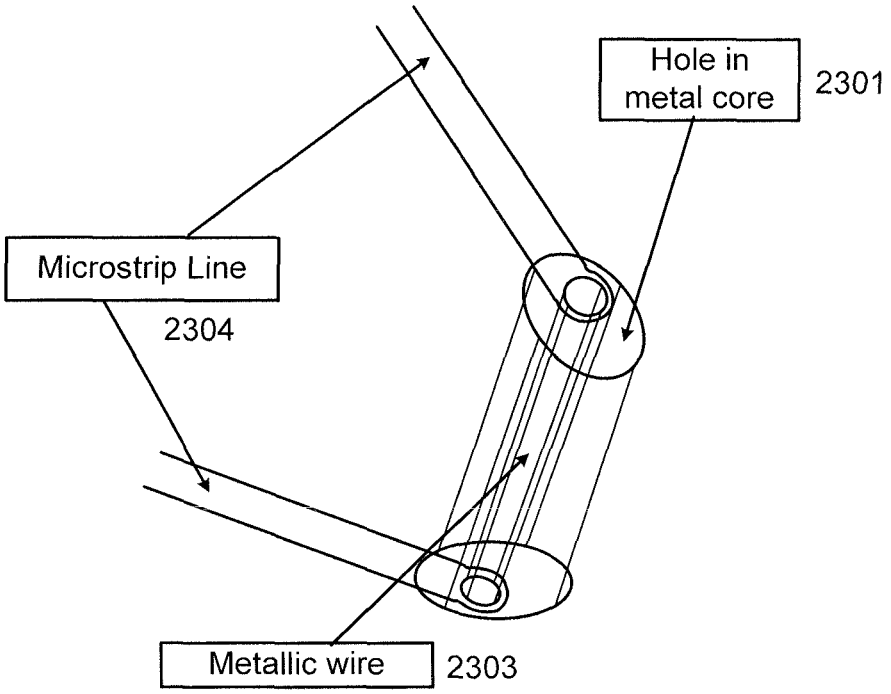
FIG. 23A illustrates a detailed view of an exemplary inclined coaxial transition.
Figure 23B:
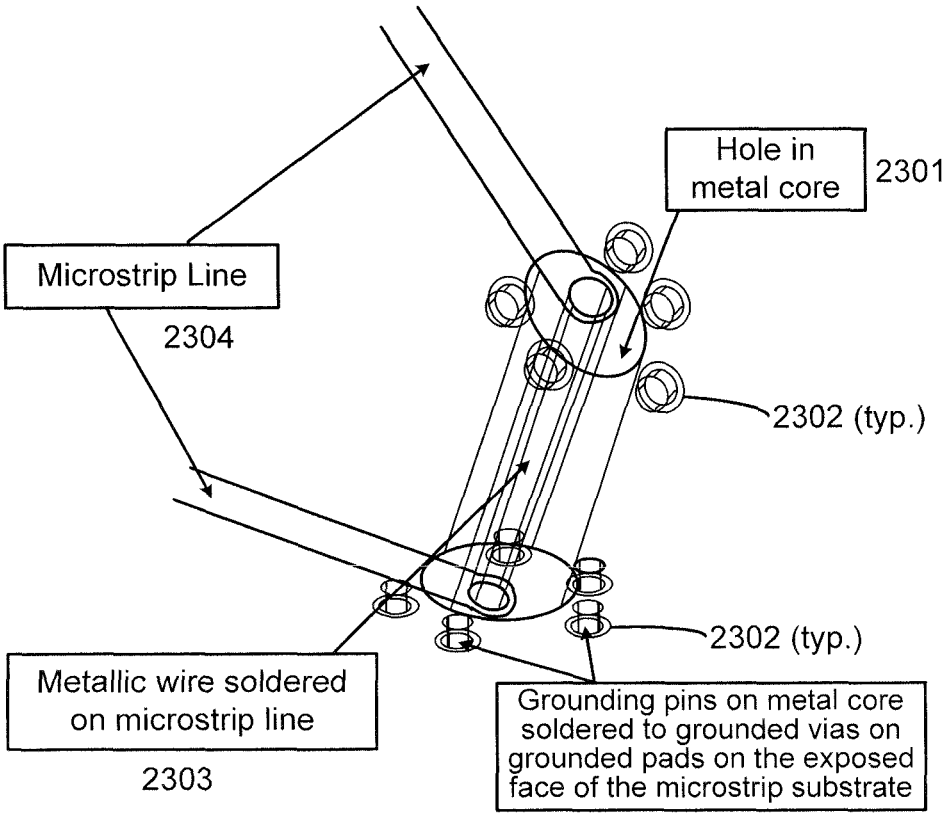
FIG. 23B illustrates a detailed view of another exemplary inclined coaxial transition with pins.

In an exemplary embodiment and with reference to FIGS. 23A-23B, a connecting hole 2301 is surrounded by grounding pins 2302, which are connected to grounded vias on grounded pads on the exposed face of the microstrip substrate. A metallic wire 2303 is connected to the two microstrip lines 2304, one on each side of two inclined surfaces. Metallic wire 2303 is located inside connecting hole 2301, and in an exemplary embodiment, does not come into contact with the metal core. Connecting hole 2301 is configured to facilitate electromagnetic coupling between two PCBs mounted on each side of the metallic piece. In exemplary embodiments, connecting hole 2301 may be circular, rectangular, H-shaped, or the like. In an exemplary embodiment, connecting hole 2301 is drilled, or otherwise formed, in the metal core either perpendicularly to one of the two faces or perpendicular to the bisector of the angle of inclination.

In an exemplary method of assembly, the PCB interconnection is assembled by manufacturing a metal core with the desired inclined plane and drilling a connecting hole either perpendicular to one of the metal surfaces, or perpendicular to the bisector angle. A section of a dielectric cylinder with a metallic wire in the center is inserted in the connecting hole. The metallic wire is cut at the level of the metal surface. Additionally, the metallic wire is bent until perpendicular, or substantially perpendicular, to the surfaces of the metal core.

Furthermore, in the exemplary method, a first PCB and a second PCB are placed on the metallic surfaces, and the metallic wire is threaded through the via-hole in the first and second PCBs and soldered to the microstrip lines.

In one exemplary method, ground planes of the first and second PCBs are grounded to the metal core. This may be facilitated by manufacturing at least one metallic pin around the coaxial aperture and soldering the metallic pins to grounded pads on the exposed surfaces of the first and second PCBs. Advantageously, the coaxial pin and the grounded pins can be soldered in a single process, thus reducing the complexity and cost of assembly. Similarly, a PCB may be replaced by disassembling the PCB interconnection in case of component failure.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The invention claimed is:

1. A single antenna aperture of an antenna system, the single antenna aperture comprising:

multiple receiving elements and multiple transmitting elements;

wherein the multiple receiving elements are interleaved with the multiple transmitting elements, wherein the multiple receiving elements are oriented in a first direction, wherein the multiple transmitting elements are oriented in a second direction, and wherein the first direction is inverted relative to the second direction, and wherein the multiple receiving elements are "T"-shaped and wherein the multiple transmitting elements are "T"-shaped; and wherein a first receiving element of the multiple receiving elements is located within a distance of about 0.5 wavelengths or less of a first transmitting element of the multiple transmitting elements, wherein a wavelength is based on the highest designed radiated frequency of the antenna system, and wherein the distance between the first receiving element and the first transmitting element is measured from the approximate center of the first receiving element to the approximate center of the first transmitting element.

2. The single antenna aperture of claim 1, wherein the first receiving element of the multiple receiving elements is located within a distance of about 1.0 wavelength or less of a second receiving element of the multiple receiving elements, wherein the distance between the first receiving element and the second receiving element is measured from the approximate center of the first receiving element to the approximate center of the second receiving element; and wherein the first transmitting element of the multiple transmitting elements is located within about 1.0 wavelength or less of a second transmitting element of the multiple transmitting elements, wherein the distance between the first transmitting element and the second transmitting element is measured from the approximate center of the first transmitting element to the approximate center of the second transmitting element.

3. The single antenna aperture of claim 1, wherein each of the "T"-shaped multiple receiving elements and each of the "T"-shaped multiple transmitting elements individually comprise two patch antennas located in separate planes, wherein the two patch antennas are parallel to each other and overlap to form the "T"-shape.

4. The single antenna aperture of claim 1, wherein the single antenna aperture is a planar antenna array, and wherein the multiple receiving elements and the multiple transmitting elements are arranged in rows in the planar antenna array.

5. The single antenna aperture of claim 1, wherein the single antenna aperture is a low profile hybrid mechanical-electronic steerable array, and wherein the multiple receiving elements and the multiple transmitting elements are inclined radiating elements.

6. The single antenna aperture of claim 1, wherein one or more of the "T"-shaped multiple receiving elements or the "T"-shaped multiple transmitting elements have trimmed or chamfered edges.

7. The single antenna aperture of claim 1, wherein one or more of the "T"-shaped multiple receiving elements or the "T"-shaped multiple transmitting elements comprise at least one of slits parallel to the resonant modes or slits perpendicular to the resonant modes.

8. An antenna system comprising:

multiple receiving elements and multiple transmitting elements, wherein the multiple receiving elements and the multiple transmitting elements share a single aperture;

wherein a first receiving element of the multiple receiving elements is located within a distance of about 1.0 wavelength or less of a second receiving element of the multiple receiving elements, wherein the distance between the first receiving element and the second receiving element is measured from the approximate center of the first receiving element to the approximate center of the second receiving element;

wherein a first transmitting element of the multiple transmitting elements is located within a distance of about 1.0 wavelength or less of a second transmitting element of the multiple transmitting elements, wherein the distance between the first transmitting element and the second transmitting element is measured from the approximate center of the first transmitting element to the approximate center of the second transmitting element; and wherein a wavelength is based on the highest designed radiated frequency of the antenna system.

9. The antenna system of claim 8, wherein the multiple receiving elements are "T"-shaped and wherein the multiple transmitting elements are "T"-shaped, and wherein the multiple receiving elements are interleaved with the multiple transmitting elements.

10. The antenna system of claim 8, wherein the multiple receiving elements are oriented in a first direction, wherein the multiple transmitting elements are oriented in a second direction, and wherein the first direction is inverted relative to the second direction.

11. The antenna system of claim 8, wherein the first receiving element of the multiple receiving elements is located within a distance of about 0.5 wavelengths or less of the first transmitting element of the multiple transmitting elements, and wherein the distance between the first receiving element and the first transmitting element is measured from the approximate center of the first receiving element to the approximate center of the first transmitting element.

12. The antenna system of claim 8, wherein the multiple receiving elements and the multiple transmitting elements are part of a low profile hybrid mechanical-electronic steerable array, and wherein the multiple receiving elements and the multiple transmitting elements are inclined radiating elements.

13. An antenna system comprising:

a plurality of rows of receiving radiating elements interleaved with a plurality of rows of transmitting radiating elements;

wherein a first receiving radiating element of the plurality of rows of receiving radiating elements is located within a distance of about 0.5 wavelengths or less of a first transmitting radiating element of the plurality of rows of transmitting radiating elements, wherein a wavelength is based on the highest designed radiated frequency of the antenna system, and wherein the distance between the first receiving radiating element and the first transmitting radiating element is measured from the approximate center of the first receiving radiating element to the approximate center of the first transmitting radiating element.

14. The antenna system of claim 13, wherein the receiving radiating elements of the plurality of rows of receiving radiating elements are oriented in a first direction, wherein the transmitting radiating elements of the plurality of rows of transmitting radiating elements are oriented in a second direction, and wherein the first direction is inverted relative to the second direction.

15. The antenna system of claim 14, wherein the receiving radiating elements are "T"-shaped and wherein the transmitting radiating elements are "T"-shaped.

16. The antenna system of claim 13, wherein the first receiving radiating element is located within a distance of about 1.0 wavelength or less of a second receiving radiating element of the plurality of rows of receiving radiating elements, wherein the distance between the first receiving radiating element and the second receiving radiating element is measured from the approximate center of the first receiving radiating element to the approximate center of the second receiving radiating element; and wherein the first transmitting radiating element is located within a distance of about 1.0 wavelength or less of a second transmitting radiating element of the plurality of rows of transmitting radiating elements, wherein the distance between the first transmitting radiating element and the second transmitting radiating element is measured from the approximate center of the first transmitting radiating element to the approximate center of the second transmitting radiating element.

* * * * *